US011346626B2

(12) United States Patent
Gueron

(10) Patent No.: US 11,346,626 B2
(45) Date of Patent: May 31, 2022

(54) DEVICE, SYSTEM AND METHOD FOR COUNTING USED MUNITION

(71) Applicant: Or Gueron, Hibat Tzion (IL)

(72) Inventor: Or Gueron, Hibat Tzion (IL)

(73) Assignee: Or Gueron, Hibat Tzion (IL)

( * ) Notice: Subject to any disclaimer, the term of this patent is extended or adjusted under 35 U.S.C. 154(b) by 8 days.

(21) Appl. No.: 16/699,117

(22) Filed: Nov. 29, 2019

(65) Prior Publication Data

US 2020/0173744 A1 Jun. 4, 2020

(30) Foreign Application Priority Data

Nov. 29, 2018 (IL) ..... 263395

(51) Int. Cl.
*F41A 9/62* (2006.01)

(52) U.S. Cl.
CPC ..... *F41A 9/62* (2013.01)

(58) Field of Classification Search
CPC ..... F41A 9/62
See application file for complete search history.

(56) References Cited

U.S. PATENT DOCUMENTS 5,142,805 A * 9/1992 Horne ..... F41A 9/62 42/1.02
7,614,333 B2 * 11/2009 Quinn ..... F41A 19/01 42/1.01
2010/0281725 A1 * 11/2010 Arbouw ..... F41A 9/62 42/1.02
2016/0069629 A1 * 3/2016 Seckman ..... F41A 9/62 42/1.02
2017/0051993 A1 * 2/2017 Imbriano ..... F41A 19/01
2017/0336160 A1 * 11/2017 Walther ..... F41A 9/70
2019/0277590 A1 * 9/2019 Masarik ..... F41A 9/70

* cited by examiner

*Primary Examiner* — J. Woodrow Eldred
(74) *Attorney, Agent, or Firm* — Pearl Cohen Zedek Latzer Baratz LLP

(57) ABSTRACT

Generally, a device for counting used munitions may include at least one sensor and at least one processor attachable to a firearm. The sensor(s) may be configured to generate at least one sensor signal, having signal values, in response to movement of at least one of: the firearm or at least one movable member of the firearm. The processor(s) may be configured to receive the sensor signal(s) from the sensor(s), and to detect, based on the signal values of the sensor signal(s) and a predetermined signal threshold, a discharge of the firearm. The processor(s) may be configured to determine a number of remaining cartridges in a magazine of the firearm, based on the detections of the discharges thereof. The device may further include at least one indicator configured to generate at least one notification concerning the number of remaining cartridges in the magazine.

17 Claims, 13 Drawing Sheets

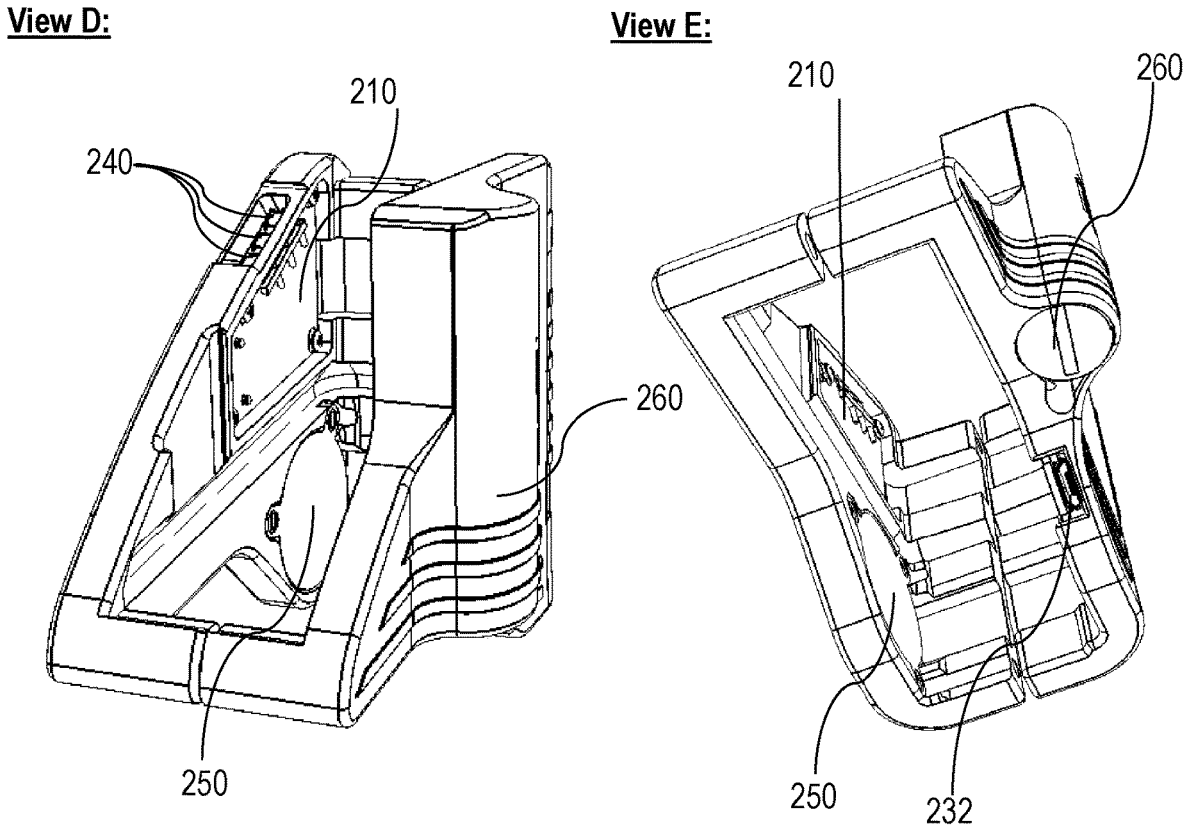
*Figure 2A (cont. 1)*

220

230

242

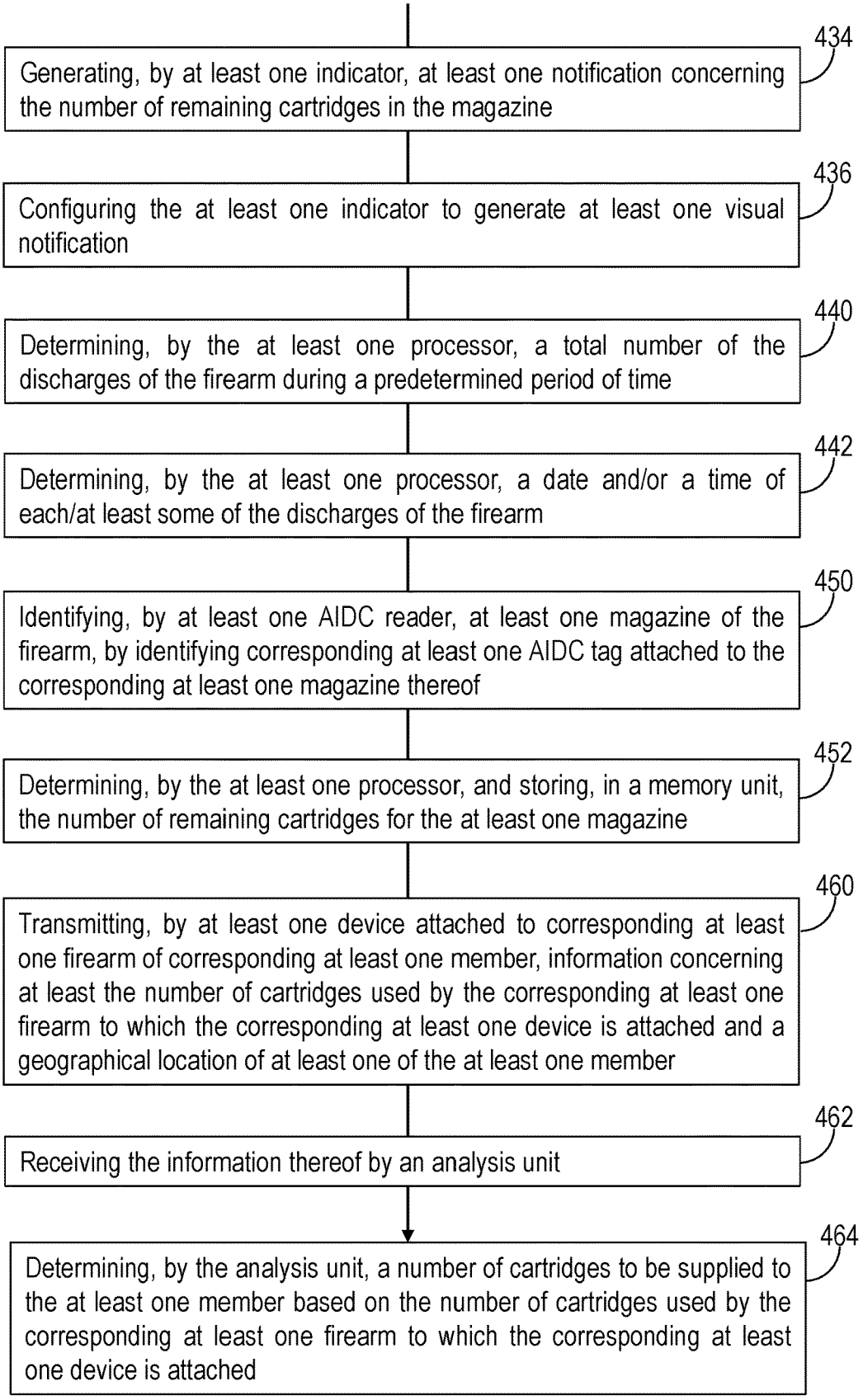
*Figure 4 (cont. 1)*

DEVICE, SYSTEM AND METHOD FOR COUNTING USED MUNITION

CROSS REFERENCE TO RELATED APPLICATIONS

This application claims priority from Israel Patent Application No. 263395, filed Nov. 29, 2018 and entitled "DEVICE, SYSTEM AND METHOD FOR COUNTING USED MUNITION", which is hereby incorporated by reference.

FIELD OF THE INVENTION

The present invention relates to the field of devices for counting used munitions and, more particularly, to accelerometer-based devices thereof.

BACKGROUND OF THE INVENTION

Unawareness of a number of remaining cartridges in a magazine of a firearm is a common problem among firearms users. Current devices for determining the number of remaining cartridges in the magazine typically have large dimensions, large weight and/or protrude from a frame of the firearm, and thereby are not designed for tactical use. Many known devices for determining the number of remaining cartridges require embedding some elements in the firearm, thereby modifying it.

SUMMARY OF THE INVENTION

One aspect of the present invention provides a device for counting used munitions, which device may include: at least one sensor attachable to a firearm and configured to generate at least one sensor signal, having signal values, in response to movement of at least one of: the firearm or at least one movable member of the firearm; and at least one processor in communication with the at least one sensor, the at least one processor is configured to: receive the at least one sensor signal from the at least one sensor, and detect, based on the signal values of the at least one sensor signal and a predetermined signal threshold, at least one discharge of the firearm.

Another aspect of the present invention provides a system for counting used munitions, which system may include: at least one counting used munition device as above attached to corresponding at least one firearm of corresponding at least one member; and an analysis unit.

Another aspect of the present invention may provide a method for counting used munitions, which method may include: generating, by at least one sensor attached to a firearm, at least one sensor signal, having signal values, in response to movement of the firearm or at least one movable member of the firearm; and detecting, by at least one processor, based on signal values of the at least one sensor signal and a predetermined signal threshold, at least one discharge of the firearm.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

Figure 1A:
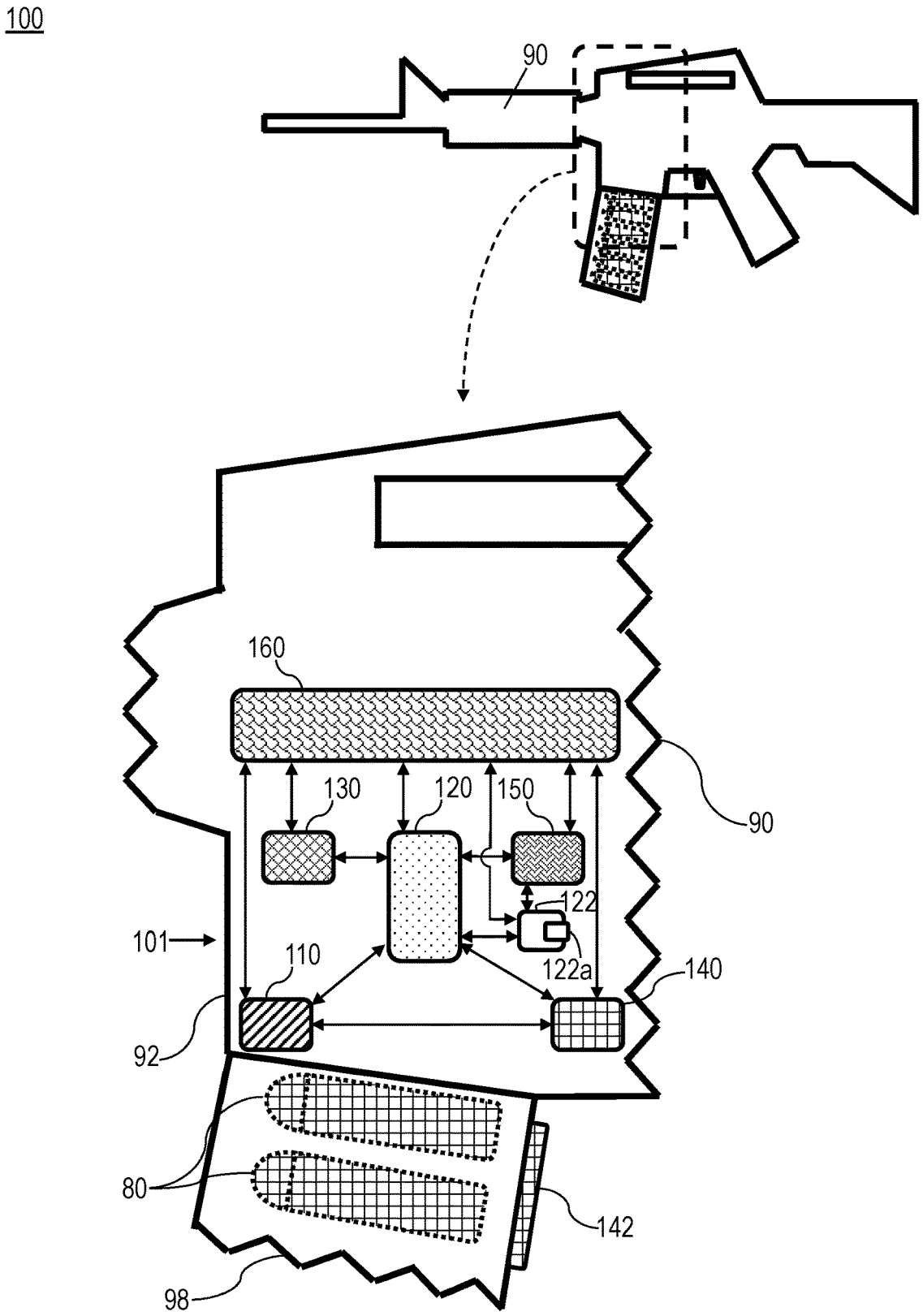
FIG. 1A is a schematic illustration of a device for counting used munitions, according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

Unless specifically stated otherwise, as apparent from the following discussions, it is appreciated that throughout the specification discussions utilizing terms such as "processing", "computing", "calculating", "determining", "enhancing" or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices. Any of the disclosed modules or units can be at least partially implemented by a computer processor.

Generally, a device and a method for counting used munitions are disclosed. According to some embodiments, the used munitions counting device may include at least one sensor attachable (or removably attachable) to a firearm and at least one processor in communication with the sensor(s). The sensor(s) may be configured to generate at least one sensor signal having signal values in response to movement/proper acceleration of the firearm or at least one movable member (e.g., a bolt) of the firearm. The processor(s) may be configured to detect, based on the signal values of the sensor signal(s) and a predetermined signal threshold, at least one discharge of the firearm.

According to some embodiments, the processor(s) may be configured to determine a number of used cartridges, based on the detections of the discharge(s) thereof and further to determine a number of remaining cartridges in a magazine, based on the number of used cartridges and an initial number of cartridges in the magazine.

According to some embodiments, the used munition counting device may include at least one indicator in communication with the processor(s). The indicator(s) may be configured to generate at least one notification (e.g., visual notification(s)) when the number of remaining cartridges in the magazine reduces below respective at least one predetermined cartridges threshold.

According to some embodiments, the used munitions counting device may be designed to be attached (or removably attached) to a specified location on the firearm (such as, for example, a magazine receiver of the firearm) in a way that enables tactic use of the device while preventing any distraction/disturbance that may be caused by the device while operating the firearm.

In some embodiments, the used munitions counting device may be mechanically attached to the firearm, without requiring any other connection to the firearm, such as magnetic, electronic, electrical or the like. In some additional or alternative embodiments, the assembly of the used munitions counting device to the firearm does not require any modification to the firearm.

Reference is now made to FIG. 1A, which is a schematic illustration of a device 100 for counting used munitions, according to some embodiments of the invention.

According to some embodiments, device 100 may include at least one sensor 110 and at least one processor 120 in communication with sensor(s) 110. Sensor(s) 110 and/or processors(s) 120 may be attachable (or removably attachable) to firearm 90.

Sensor(s) 110 may be configured to detect movement of at least one of: firearm 90 or at least one movable member (e.g., a bolt) of firearm 90. Sensor(s) 110 may be configured to generate at least one sensor signal in response to the movement of firearm 90 or the at least one movable member of firearm 90. The sensor signal(s) may include signal values.

In some embodiments, sensor(s) 110 may be accelerometer(s), and the signal values of the sensor signal(s) may be indicative of physical acceleration of firearm 90 or of the at least one movable member of firearm 90.

In some embodiments, the movement/physical acceleration of firearm 90 or of the at least one movable member of firearm 90 may be due to a discharge of firearm 90 (e.g., firing/shooting of a bullet by/from firearm 90). For example, the movement/physical acceleration of firearm 90 may include a recoil (e.g., backward movement of firearm 90 upon discharge). In another example, the movement/physical acceleration of the at least one movable member of firearm 90 may include movement of the bolt of firearm 90 during extraction of cartridge 80 from magazine 98 and/or during feeding of cartridge 80 by the bolt into a chamber of firearm 90 upon the discharge.

Alternatively or complementarily, the movement/physical acceleration of firearm 90 or of the at least one movable member of firearm 90 may be due to movement(s) of a user or movement(s) of firearm 90 by the user, for example during carrying or aiming of firearm 90.

According to some embodiments, the movement/physical acceleration of firearm 90 or of the at least one movable member of firearm 90 due to the at least one discharge of firearm 90 (e.g., recoil, movements of the bolt) may result in corresponding at least one section in the sensor signal(s) in which the signal values exceed a predetermined signal threshold.

In some embodiments, the signal threshold thereof may be predetermined, for example, prior to actual use of device 100. In some embodiments, the predetermined signal threshold may be no less than 250 $m/s^2$. It would be apparent to those skilled in the art that the predetermined signal threshold may also obtain different values and may depend on, for example, the type of firearm 90.

The predetermined signal threshold thereof may be used to differentiate the movement/physical acceleration of firearm 90 and/or of the at least one movable member of firearm 90 caused by the discharge of firearm 90 from the movement/physical acceleration of firearm 90 caused by other types of movements of firearm 90 (such as, for example, carrying or aiming of firearm 90 by the user).

According to some embodiments, processor(s) 120 may be configured to receive the sensor signal(s) from sensor(s) 110. Processor(s) 120 may be configured to detect, based on the signal values of the sensor signal(s) and the predetermined signal threshold, at least one discharge of firearm 90.

For example, processor(s) 120 may be configured to detect at least one section in the sensor signal(s) in which the signal values exceed the predetermined signal threshold, to thereby identify corresponding at least one discharge of firearm 90 (e.g., as described below with respect to FIGS. 1B, 1C, 1D and 1E).

In some embodiments, processor(s) 120 may be configured to determine a number of used cartridges 80, based on the detections of the discharge(s) thereof.

In some embodiments, processor(s) 120 may be configured to determine a number of remaining cartridges 80 in magazine 98, based on an initial number of cartridges 80 in magazine 98 and the number of used cartridges 80. The initial number of cartridges 80 in magazine 80 may be predetermined (e.g., prior to actual use of device 100) according to common practice/definitions of particular users. For example, some users may define magazine 98 of M-16 assault rifle filled with 29 cartridges 80 as completely full magazine, while other users may define magazine 98 filled with 30 cartridges 80 as completely full magazine.

In some embodiments, processor(s) 120 may be further configured to determine a total number of the discharges of firearm 90 during a predetermined period of time (e.g., minutes, hours, days, months, etc.). The total number of the discharges of firearm 90 during the predetermined period of time may be used to, for example, determine/perform periodic preventive maintenance procedures aiming to ensure the physical function of firearm 90.

In various embodiments, processor(s) 120 may be further configured to determine and record a date and/or a time of each/at least one of the discharges of firearm 90 during a predetermined period of time.

According to some embodiments, device 100 may include a memory unit 122 in communication with processor(s) 120 (e.g., as shown in FIG. 1A). Device 100/memory unit 122 may further include a first communication interface 122*a* in communication with memory unit 122 (e.g., as shown in FIG. 1A). In some embodiments, first communication interface 122*a* may be, for example, a micro-USB.

In these embodiments, processor(s) 120 may be further configured to store in memory unit 122 information concerning at least one of: the number of remaining cartridges 80 in particular magazine 98, the total number of the discharges of firearm 90 during the predetermined period of time, and the date and/or the time of each/at least some of the discharges of firearm 90. The information thereof may be extracted from memory unit 122 using first communication interface 122*a* (e.g., micro-USB or any other communication interface port known in the art).

According to some embodiments, device 100 may include at least one indicator 130 (e.g., as shown in FIG. 1A). Indicator(s) 130 may be attachable (or removable attachable) to firearm 90. Indicator(s) 130 may be in communication with processor(s) 120. In some embodiments, indicator(s) 130 may be configured to generate at least one notification indicative of, for example, the number of remaining cartridges 80 in magazine 98. In some embodiments, indicator(s) 130 may be arranged to generate at least one visual notification (e.g., using one or more light emitting diode (LED), as described below with respect to FIG. 2A).

According to some embodiments, device 100 may include an automatic identification and data capture (AIDC) reader 140 (e.g., as shown in FIG. 1A). AIDC reader 140 may be coupled to processor(s) 120. In some embodiments, AIDC reader 140 may be a radiofrequency identification (RFID) reader. It would be appreciated that AIDC reader 140 may be any other AIDC reader 140 known in the art (e.g., rather than RFID reader).

In these embodiments, device 100 may be part of a kit including device 100 and at least one AIDC tag 142. AIDC tags 142 may be attachable (or removably attachable) to different magazines 98 to be used with firearm 90 (e.g., as shown in FIG. 1A). In these embodiments, AIDC reader 140 may be configured to identify different magazines 98 that may be inserted into/used by firearm 90 by identifying corresponding different AIDC tags 142 attached thereto.

In these embodiments, processor(s) 120 may store in memory unit 122 information concerning the number of remaining cartridges 80 in particular magazine(s) 98. Each of particular magazines 98 may be identified by AIDC reader 140 using the respective AIDS tag 142 attached to the respective particular magazine 98 thereof. In these embodiments, processor(s) 120 may retrieve (from memory unit 122) the information concerning the number of remaining cartridges 80 in particular magazine(s) 98, for example upon extraction and reinsertion of the particular magazine(s) 98 thereof from/to firearm 90. Accordingly, the user of firearm 90 may, for example, extract particular magazine 98 from firearm 90, and then reinsert it, or switch between different magazines 98, without losing the information concerning the number of remaining cartridges 80 in the magazine(s) thereof.

In some embodiments, AIDC reader 140 may be configured to write/save information concerning the number of remaining cartridges 80 in particular magazine(s) 98 onto AIDC tag 142 attached to the respective magazine 98.

According to some embodiments, device 100 may include a second communication interface 150. Second communication interface 150 may be, for example, one of: Bluetooth, Wi-Fi, etc. Second communication interface 150 may be in communication with processor(s) 120 and/or memory unit 122. Second communication interface 150 may be configured to transmit information stored in processor(s) 120/memory unit 122. The information stored in processor(s) 120/memory unit 122 may, for example, include the number of remaining cartridges 80 in particular magazines 98, the total number of the discharges of firearm 90 during the predetermined period of time, the date and/or the time of each/at least some of the discharges of firearm 90.

According to some embodiments, device 100 may include a power source 160 (e.g., as shown in FIG. 1A). Power source 160 may be in communication with at least one of: sensor(s) 110, processor(s) 120, memory unit 122, indicator(s) 130, AIDC reader 140 and/or second communication interface 150. In some embodiments, power source 160 may be a battery (e.g., AAA battery), a rechargeable battery, a capacitor, and the like.

According to some embodiments, device 100 may include a housing arranged to accommodate at least one of: sensor(s) 110, processor(s) 120, memory unit 122, indicator(s) 130, AIDC reader 140 and/or second communication interface 150 (e.g., as described below with respect to FIG. 2A).

Device 100 may be attachable (or removably attachable) to firearm 90 at one or more specified locations 101. In some embodiments, specified location 101 may be a magazine receiver 92 of firearm 90 (e.g., as shown in FIG. 1A).

It would be appreciated that device 100 may be attachable to different specified locations 101 on firearm 90 (rather than magazine receiver 92). In various embodiments, specified location(s) 101 may be selected based on a type of firearm 90 to enable easy and convenient use of device 100 by the user and/or to prevent any distraction/disturbance that may be caused by device 100 to the user while operating firearm 90.

It would also be appreciated that device 100 may be attached to different types of firearms 90, such as for example, assault rifles, handguns, etc.

According to various embodiments, device 100 may be implemented within or designed as a supplementary device for firearm 90. For example, device 100 may be designed/have a form of a forward grip that may be connected to firearm 90.

Figure 1B:
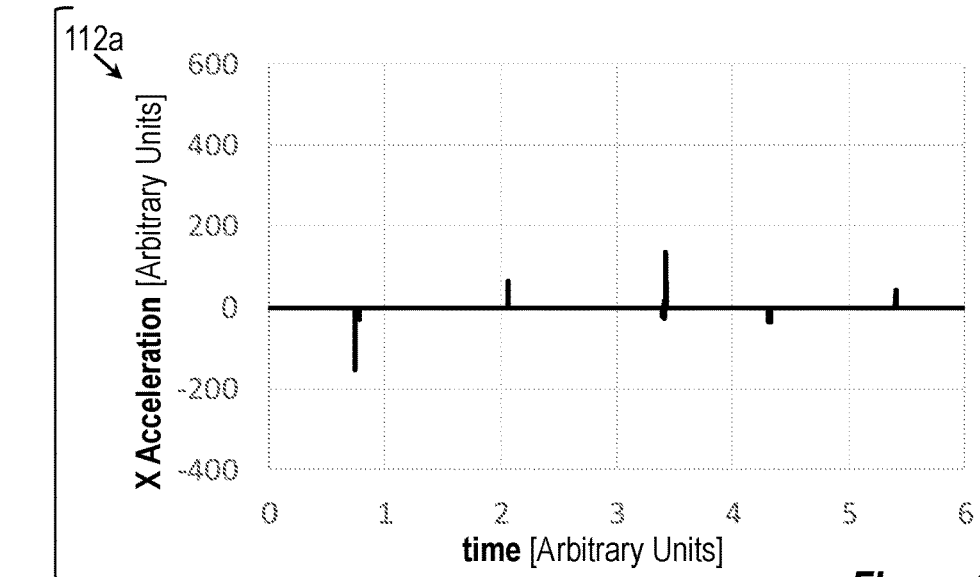
FIGS. 1B, 1C and 1D depict graphs of sensor signals generated by at least one sensor of the device along time for reflecting discharges of a firearm that may be used for counting used munitions, according to some embodiments of the invention.
Figure 1C:
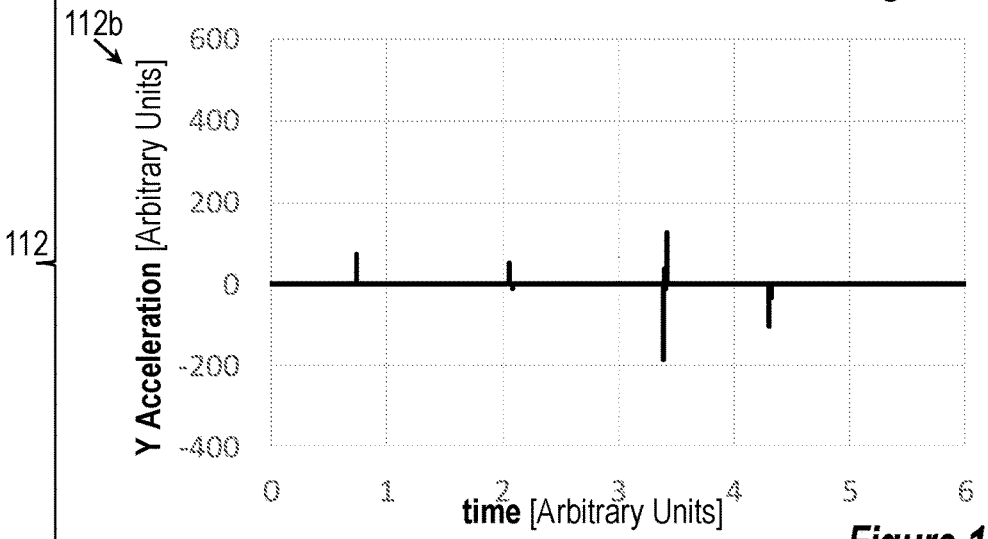
Figure 1D:
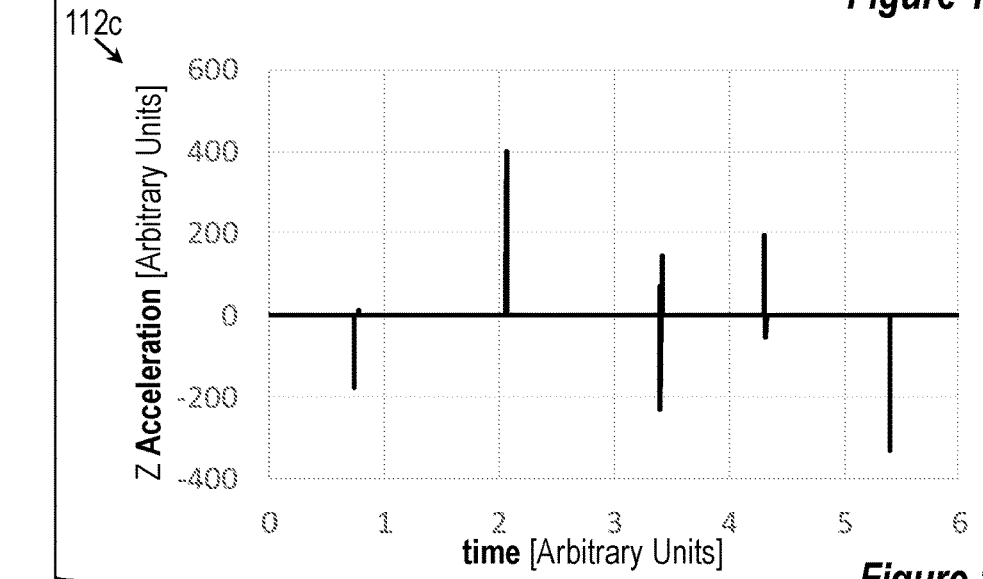
Figure 1E:
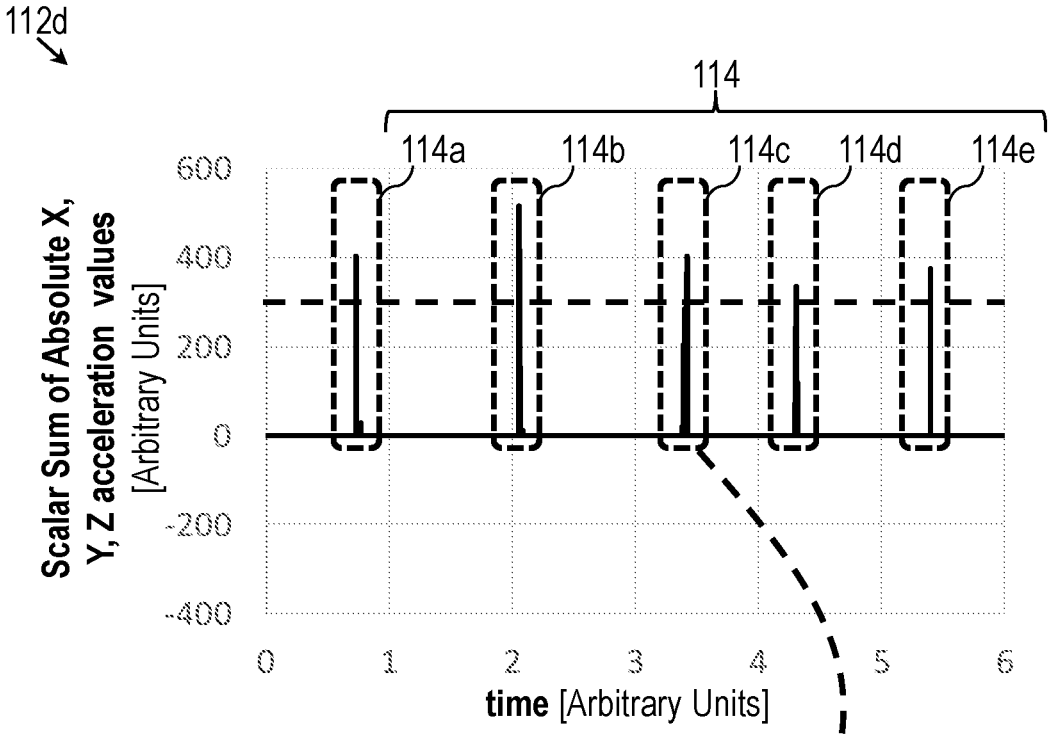
FIGS. 1E and 1F depict graphs of an array of a scalar sum of the sensor signals generated by the at least one sensor of the device, according to some embodiments of the invention.
Figure 1F:
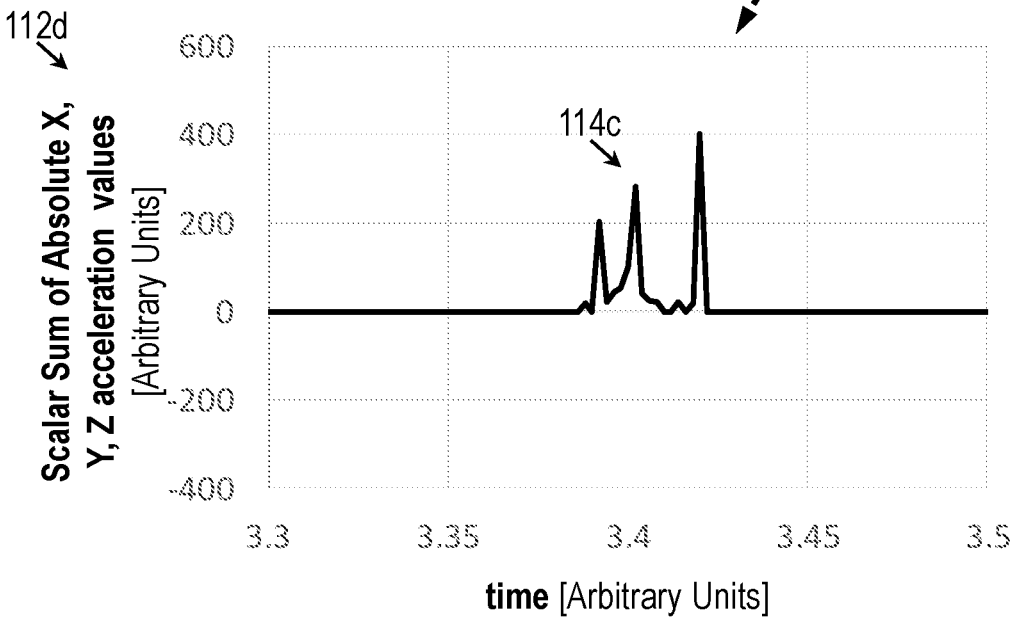

Reference is now made to FIGS. 1B, 1C and 1D, which depict graphs of sensor signals 112*a*, 112*b* and 112*c*, respectively, generated by sensor(s) 110 of a device 100 along time for reflecting discharges of firearm 90 that may be used for counting used munition, according to some embodiments of the invention. In various embodiments, signals 112*a*, 112*b*, 112*c* may represent an acceleration of firearm 90 or of a movable member of firearm 90 in arbitrary X axis, and/or in arbitrary Y axis and/or in arbitrary Z axis of an arbitrary cartesian coordinates system, respectively. Reference is also made to FIGS. 1E and 1F which depict graphs of an array 114*d* of scalar sum of signals 112*a*, 112*b*, 112*c*, respectively, generated by sensor(s) 110 of device 100, according to some embodiments of the invention. Scalar sum array 112*d* of signals 112*a*, 112*b*, 112*c* from X, Y and Z axes, respectively, may represent a sum of absolute acceleration values in the arbitrary X, Y, Z axes of the arbitrary cartesian coordinates system.

According to some embodiments, sensor(s) 110 of device 100 may generate sensor signals 112 in, for example, three arbitrary cartesian axes of an arbitrary cartesian coordinates system. For example, FIGS. 1B, 1C and 1D show graphs of sensor signals 112*a*, 112*b* and 112*c*, respectively, representing physical acceleration of firearm 90 or of at least one movable member of firearm 90 in the arbitrary X, Y and Z axes, respectively.

In some embodiments, processor(s) 120 may be configured to filter sensor signals 112. The filtering thereof may be configured to, for example, reduce a noise in sensor signals 112.

In some embodiments, processor(s) 120 may be configured to determine an array 114*d* of scalar sum of absolute signal values of sensor signals 112*a*, 112*b*, 112*c* along time. For example, FIG. 1E shows graph of scalar sum array 112*d* of absolute acceleration values 112*a*, 112*b* and 112*c* in the X, Y and Z directions, respectively.

In some embodiments, processor(s) 120 may be further configured to detect at least one section 114 in scalar sum array 112*d* in which the absolute signal values of sensor signals 112*a*, 112*b*, 112*c* exceed the predetermined signal threshold (for example, 300 $m/s^2$) to thereby identify at least one section 114 as corresponding at least one discharge of firearm 90. It is noted that the predetermined signal threshold is indicated in FIG. 1E by dashed line.

For example, the graph on top of FIG. 1E shows 5 (five) sections 114 (e.g., sections 114*a*, 114*b*, 114*c*, 114*d*, 114*e*) in which the absolute signal values of sensor signals 112*a*, 112*b*, 112*c* in scalar sum array 114*d* exceed the predetermined signal threshold of 300 $m/s^2$ and identified by processor(s) 120 as discharges of firearm 90.

In some embodiments, at least one of sections 114 indicative of discharge of firearm 90 may include a specific signal pattern. The specific signal pattern may, for example, include two or more peaks (e.g., as shown in the graph on bottom of FIG. 1E, which is a zoom on section 114*c*). In some embodiments, the specific signal patterns thereof may be used (e.g., by processor(s) 120) to identify sections 114 indicative of the discharge of firearm 90.

Reference is now made to FIGS. 2A, 2B, 2C, 2D and 2E, which are schematic illustrations of a more detailed aspect of a device 200 for counting used munition, according to some embodiments of the invention.

Figure 2A:
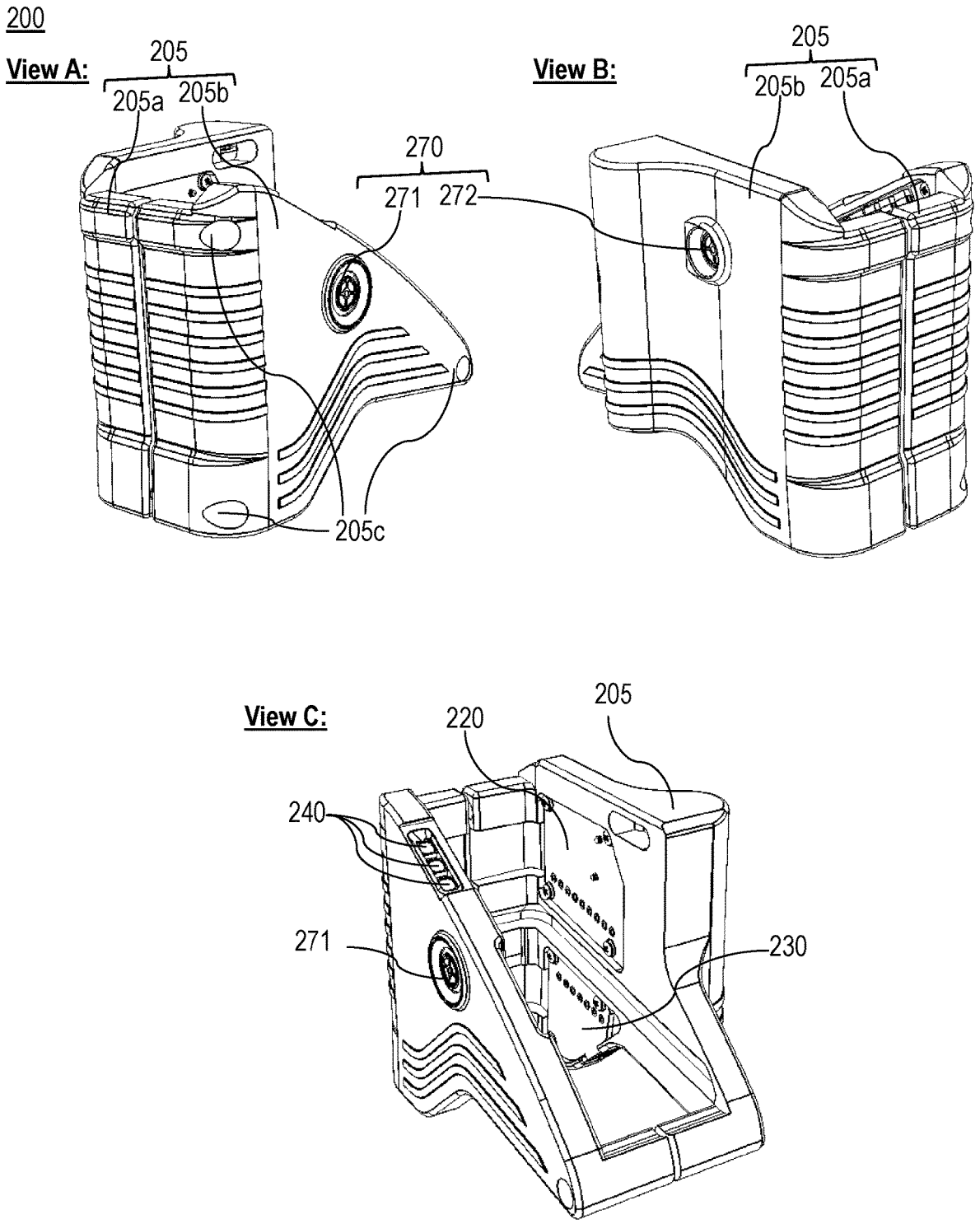
FIGS. 2A, 2B, 2C, 2D and 2E are schematic illustrations of a more detailed aspect of the device for counting used munitions, according to some embodiments of the invention.

According to some embodiments, device 200 (different views of which are shown in FIG. 2A) may include a housing 205. Housing 205 may be configured to be attached (or removably attached) to the specified location on firearm 90. For example, housing 205 shown in FIG. 2A may be configured to be removably attached to magazine receiver 92 on firearm 90 (e.g., as described above with respect to FIG. 1A).

In some embodiments, housing 205 may include a first housing part 205*a* and a second housing part 205*b* (e.g., as shown in FIG. 2A). First housing part 205*a* and second housing part 205*b* may be connected using one or more connectors. For example, first housing part 205*a* and second housing part 205*b* may be configured to envelope magazine receiver 92 of firearm 90 (not shown in FIG. 2A) and then may be connected by three bolts (e.g., via three bolts ports 205*c*).

It would be appreciated that housing 205 of device 200 may have other shapes and dimensions that may be determined based on the specified location on firearm 90 intended to receive device 200 and/or based on the type of firearm 90 to be used with.

Figure 2B:
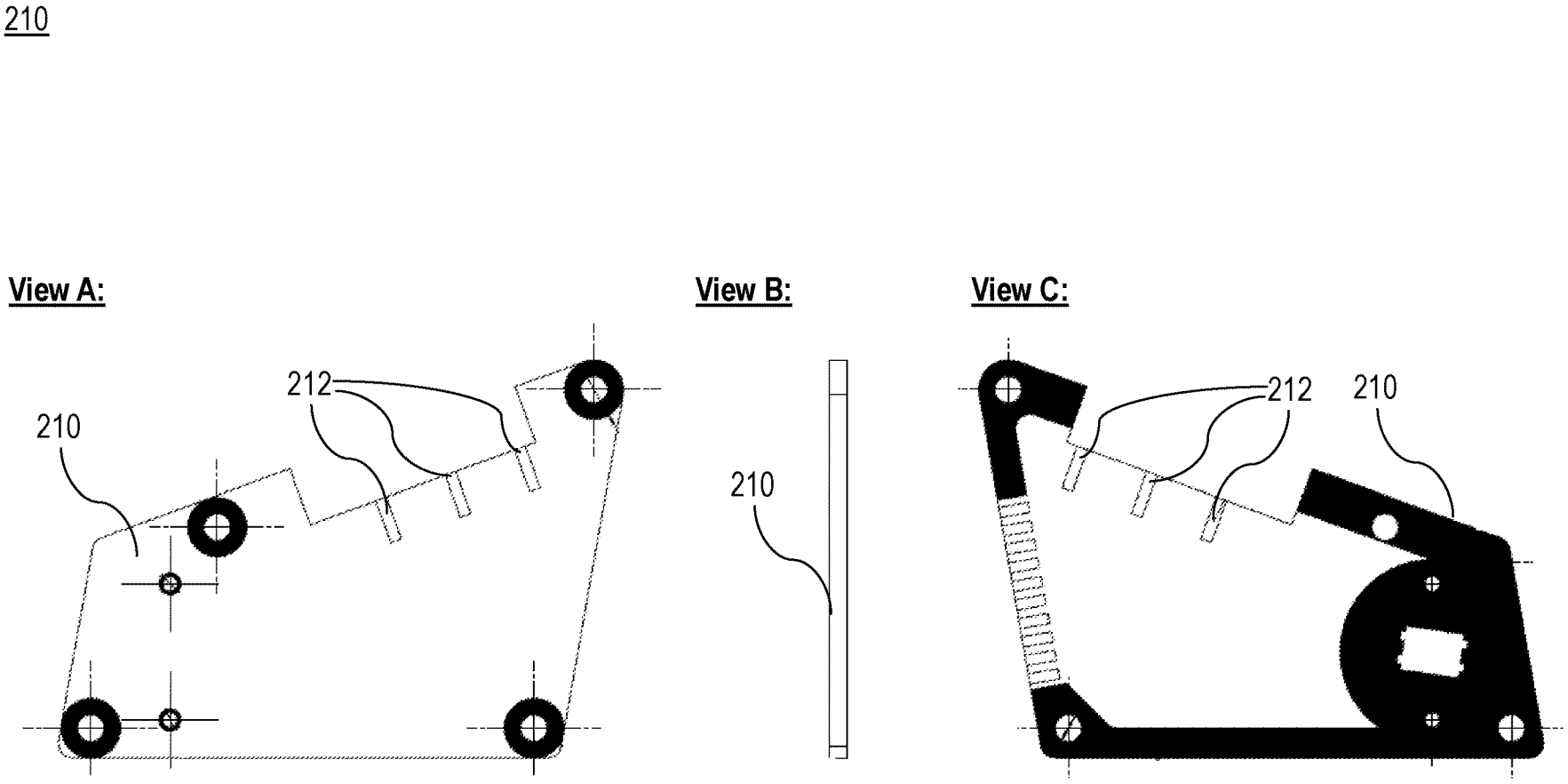

According to various embodiments, device 200 may include a first electric circuitry 210 (e.g., as shown in FIG. 2A). FIG. 2B further shows different views of first electric circuitry 210 (including pads 212 for indicator(s) 240 (e.g., as described below)). First electric circuitry 210 may, for example, include at least one sensor and at least one processor. In various embodiments, the at least one sensor and the at least one processor of first electric circuitry 210 may be similar to sensor(s) 110 and processor(s) 120 described above with respect to FIG. 1A.

Figure 2C:
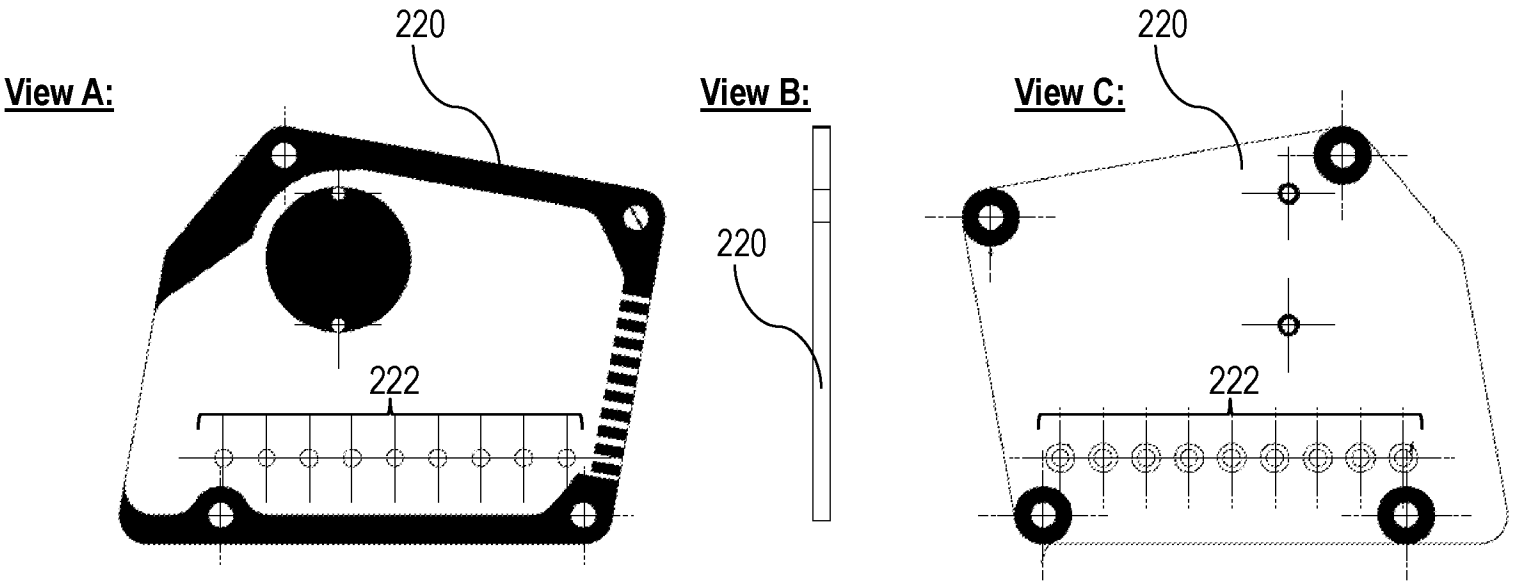

According to some embodiments, device 200 may include a second electric circuitry 220 in communication with first electric circuitry 210 (e.g., as shown in FIG. 2A). FIG. 2C further shows different views of second electric circuitry 220 (including soldering pads 222 for wires). Second electric circuitry 220 may, for example, include a memory unit. In some embodiments, the memory unit of second electric circuitry 220 may be similar to memory unit 122 described above with respect to FIG. 1A.

Figure 2D:
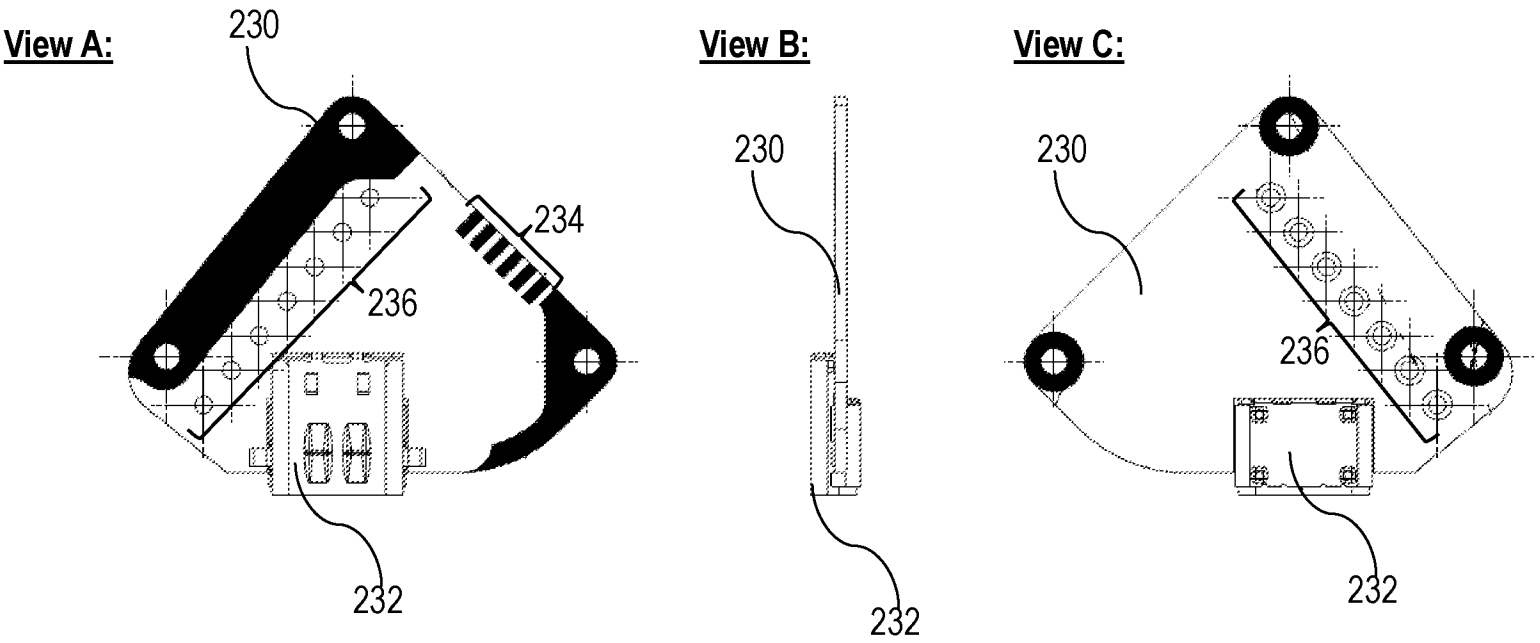

According to some embodiments, device 200 may include a third electric circuitry 230 in communication with first electric circuitry 210 and/or second electric circuitry 220. FIG. 2D further shows different views of third electric circuitry 230 (including soldering pads 234 for flats, soldering pads 236 for wires). Third electric circuitry 230 may, for example, include a communication interface 232 (e.g., such as micro-USB as shown in FIGS. 2A and 2D). In some embodiments, the communication interface 232 of third electric circuitry 230 may be similar to first communication interface 122*a* described above with respect to FIG. 1A.

It will be appreciated that the division of the electric circuitries to first, second and third electric circuits 210, 220, 230, respectively, as presented above is an example of a one embodiment. In other embodiments, the circuitry may be implemented on a different, smaller or larger, number of elements as may fit the device's design requirements and constrains. In some embodiments, the division of the circuitry into two or more units may be done to comply with physical design requirements, such as good grip of the firearm and minimal interference with its operation.

According to some embodiments, device 200 may include at least one indicator 240 in communication with first electric circuitry 210 and/or second electric circuitry 220 (e.g., as shown in FIG. 2A). In some embodiments, indicator(s) 240 may be similar to indicator(s) 130 described above with respect to FIG. 1A.

Figure 2E:
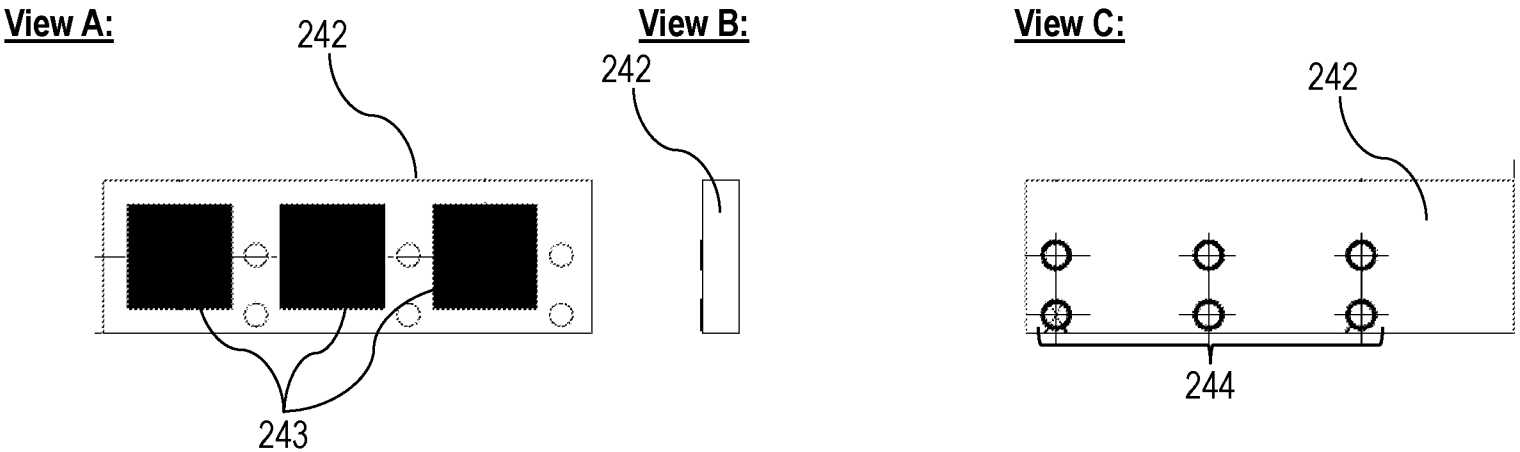

In some embodiments, indicator 240 may include one or more visual indictors, such as light-emitting diodes (LEDs). For example, FIG. 2A shows indicator 240 that includes three LEDs. FIG. 2E further shows different views of a printed circuit board 242 for LEDs of indicator(s) 240 (including specific locations 243 for the LEDs and pads 244 for pin soldering).

Indicator(s) 240 may generate at least one visual notification indicative of, for example, the number of remaining cartridges 80 in magazine 98 of firearm 90 (cartridges 80 and magazine 98 are not shown in FIG. 2A but shown and described above in/with respect to FIG. 1A). The number of remaining cartridges 80 in magazine 98 may be determined by the processor(s) of first electric circuitry 210 based on signal(s) of the sensor(s) of first electric circuitry 210, for example as described above with respect to FIG. 1A.

In some embodiments, each of the visual notification(s) may be generated when the number of remaining cartridges 80 in magazine 98 reduces below respective cartridges threshold number. For example, LEDs of indicator 240 may generate green light when magazine 98 is full, orange light when the number of remaining cartridges 80 in magazine 98 is 50% of its initial value, flickering red light when the number of remaining cartridges 80 in magazine 98 is 30% of its initial value, and/or continuous red light when magazine 98 is empty. It would be appreciated that other indicators 240 and/or other notifications may also be used.

According to some embodiments, device 200 may include at least one AIDC reader 250 in communication with first electric circuitry 210 and/or second electric circuitry 220. In some embodiments, AIDC reader 250 may be similar to AIDC reader 140 described above with respect to FIG. 1A. In these embodiments, device 200 may be part of a kit including device 200 and at least one AIDC tag (AIDC tags are not shown in FIG. 2A but described above with respect to FIG. 1A).

According to some embodiments, device 200 may include least one power source 260 in communication with first electric circuitry 210, second electric circuitry 220, third electric circuitry 230, indicator(s) 240 and/or AIDC reader 250. In some embodiments, power source(s) 260 may be similar to power source(s) 160 described above with respect to FIG. 1A.

According to some embodiments, device 200 may include a user interface 270 in communication with first electric circuitry 210 and/or second electric circuitry 220. In some embodiments, user interface 270 may include a first switch 271 and a second switch 272. First switch 271 and second switch 272 may be on, for example, external surface of housing 205 (e.g., as shown in FIG. 2A).

In some embodiments, first switch 271 may be configured to initiate at least one of the following actions: check/determine the number of the remaining cartridges 80 in magazine 98, switch off indicator(s) 240 (e.g., dimming of the LEDs of indicator 240), and/or check/determine the status of power source(s) 260.

In some embodiments, different triggering of first switch 271 may results in different action of the actions thereof. For example, a single press on first switch 271 may switch off indicator(s) 240, while a double-press on first switch 271 may initiate the checking of the status of power source(s) 260.

In various embodiments, second switch 272 may be configured to reset/delete at least a part of the information stored in the processor(s) or the memory unit of device 200. In some embodiments, second switch 272 may be configured to reset/delete the information concerning the number of cartridges 80 in particular magazine 98 inserted in magazine receiver 92 of firearm 90. In some embodiments, second switch 272 may be configured to reset/delete the information concerning all magazines 98 being used with firearm 90.

In some embodiments, different triggering of second switch 272 may results in different action described above. For example, a single press on second switch 272 may reset/delete the information concerning the number of cartridges 80 in particular magazine 98 inserted in magazine receiver 92 of firearm 90, while a continuous press on second switch 272 for a predetermined time duration may reset/delete the information concerning all magazines 98 being used with firearm 90.

According to some embodiments, housing 205 may be configured to accommodate at least one of first electric circuitry 210, second circuitry 220, third electric circuitry 230, indicator(s) 240, AIDC reader(s) 250, power source(s) 260 and/or user interface 270 (e.g., as shown in FIG. 2A).

Figure 3A:
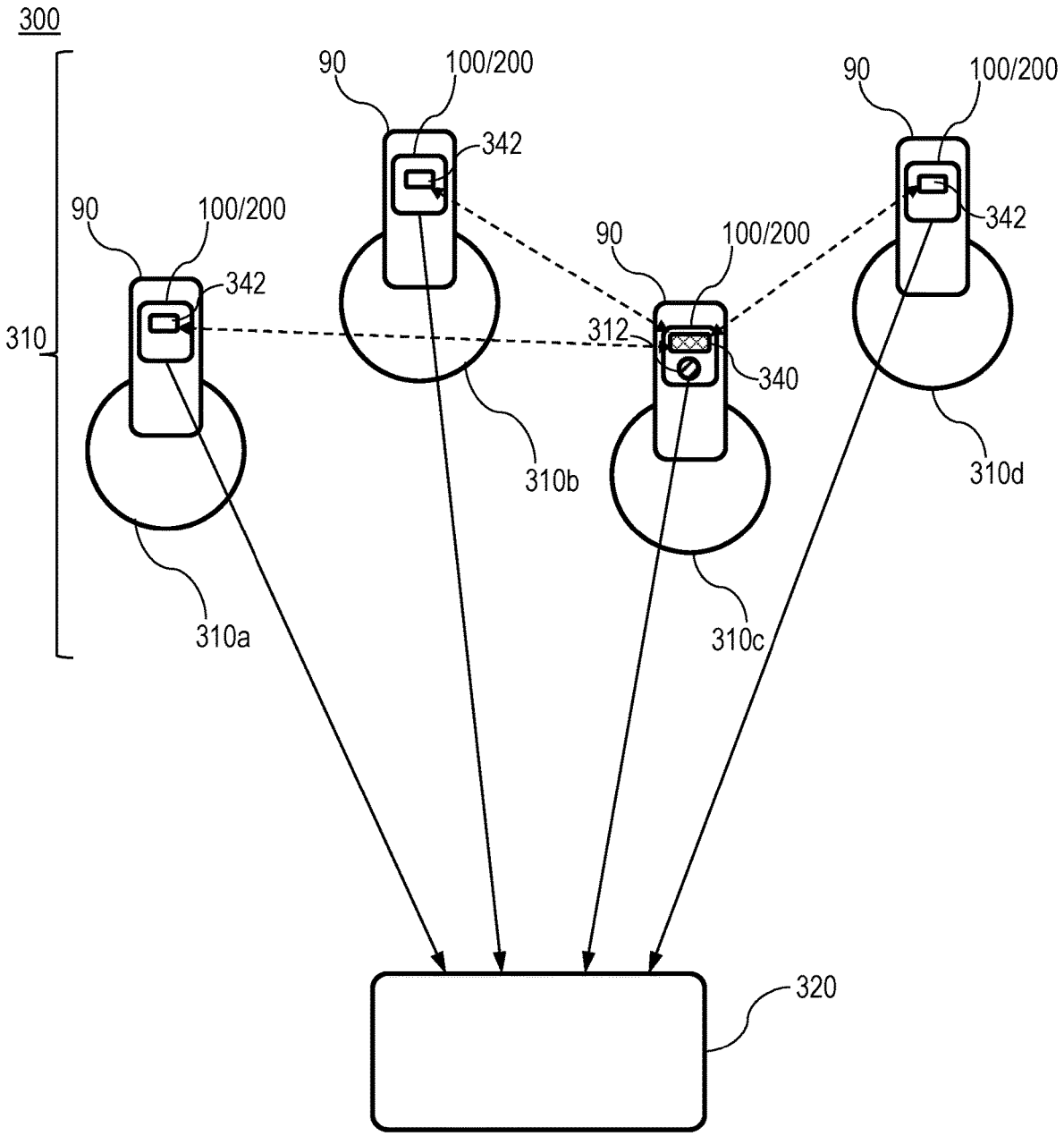
FIGS. 3A and 3B are schematic block diagram illustrations of a system for counting used munitions, according to some embodiments of the invention.
Figure 3B:
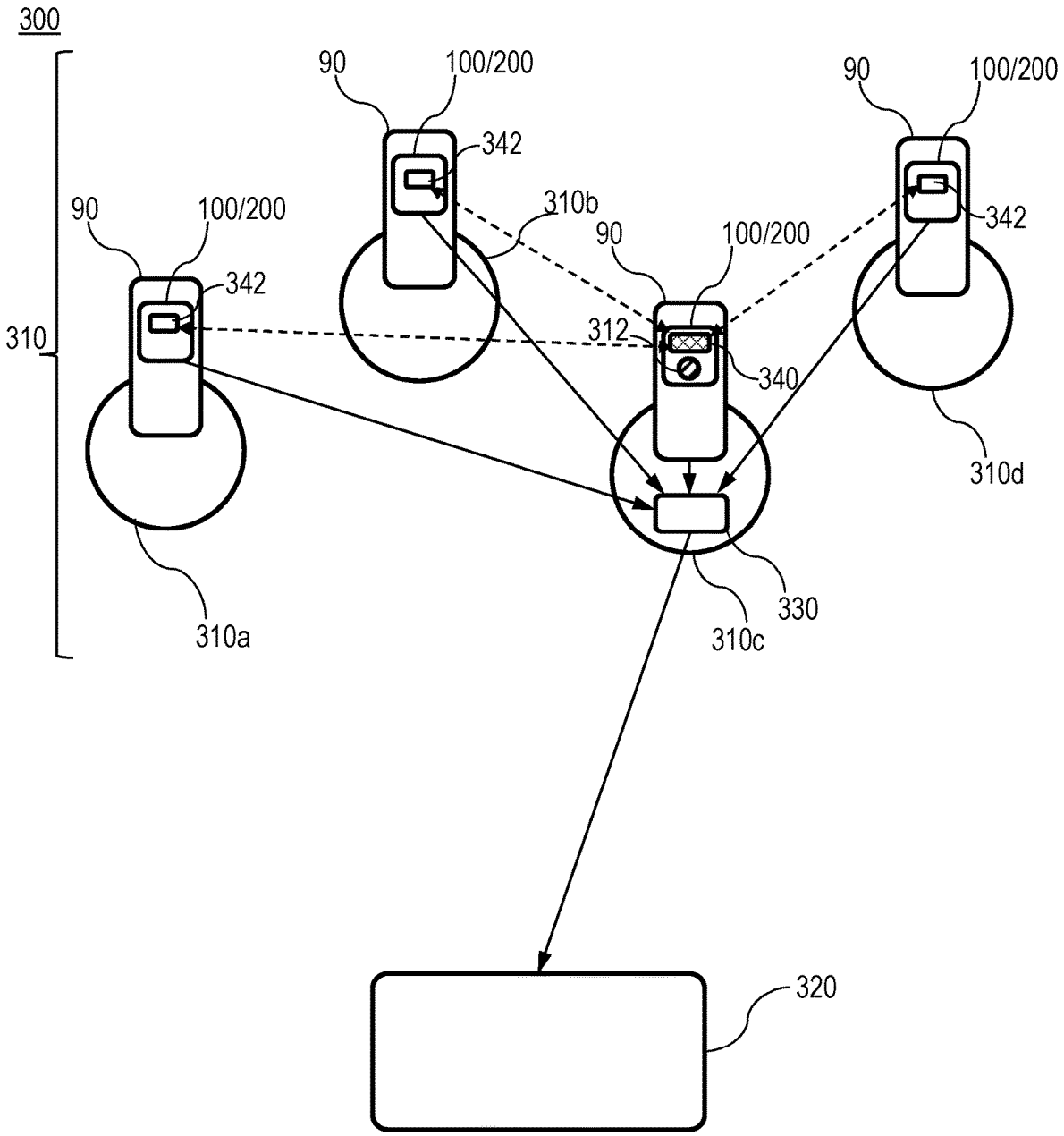

Reference is now made to FIGS. 3A and 3B, which are schematic block diagrams illustrations of a system 300 for counting used munitions, according to some embodiments of the invention.

According to some embodiments, system 300 may include one or more members 310 and an analysis unit 320.

Members 310 may be, for example, soldiers each carrying firearm 90 with the used munition counting device (e.g., such as device 100 as described above with respect to FIGS. 1A-1E or device 200 as described above with respect to FIGS. 2A-2E) attached thereto (e.g., as shown in FIGS. 3A and 3B). For example, FIGS. 3A and 3B show system 300 that includes four members 310*a*, 310*b*, 310*c* and 310*d*.

In some embodiments, analysis unit 320 may be located in, for example, headquarters.

In various embodiments, each/at least one of the used munitions counting devices attached to firearms 90 being used by respective members 310 may transmit (e.g., using the second communication interface, as discussed above with respect to FIGS. 1A and 2A) to analysis unit 320 at least a portion of the information being determined by the processor(s) and/or stored in the memory unit of the respective device (e.g., as indicated by solid arrows in FIG. 3A).

In some embodiments, at least one of the used munitions counting devices being used by at least one member of members 310 may include a geolocation sensor 312 (for example, the device of member 310*c*, as shown in FIGS. 3A and 3B). In these embodiments, the information being transmitted by the at least one used munition counting device having geolocation sensor 312 may further include a geographical location of the respective at least one member.

Alternatively or complementarily, at least one of members 310 may include a retransmitting unit 330 (e.g., as shown in FIG. 3B). For example, FIG. 3B shows system 300 in which member 310*c* includes retransmitting unit 330. Retransmitting unit 330 may receive the information determined by the processor(s) and/or stored in the memory unit(s) of each/at least one of used munitions counting device(s) coupled to firearm(s) 90 of all/at least one of members 310 and retransmit the information thereof to analysis unit 320.

Analysis unit 320 may receive the information thereof and determine, based on the information thereof at least one of: the geographical location of at least one of members 310 and/or the total number of the discharges of all/at least one of firearms 90 being used by respective at least one of members 310.

In some embodiments, analysis unit 320 may determine, based on at least the total number of the discharges of all/at least one of firearms 90 being used by at least one of members 310, at least one of: a battle intensity (e.g., if the total number of the discharges thereof exceeds a predetermined discharges threshold, the battle may be defined as intensive), and a number of cartridges 80 to be supplied to members 310.

According to some embodiments, at least one of used munitions counting devices being used by corresponding at least one member of members 310 may include a members status check interface 340 (e.g., a commander, for example member 310*c*), while at least one of other members of members 310 may include a members status check transceiver 342 (e.g., members 310*a*, 310*b*, 310*d*). Members status check interface 340 may be in communication with members status check transceivers 342 (e.g., as indicated by dashed double-arrows in FIGS. 3A and 3B).

In some embodiments, the at least one member of members 310 having the used munitions counting device with members status check interface 340 may transmit at least one status check signal to other members of members 310 having the used munitions counting devices with members status check transceivers 342.

The used munitions counting devices of at least one of members 310 may receive (using members status check transceivers 342) the status check signal and indicate (e.g., using the indicators) the respective member concerning the receipt of the signal thereof. In some embodiments, members status check transceivers 342 of at least one of members 310 may transmit (e.g., using members status check transceivers 342) a reply status signal that may be received by members status check interface 340 of at least one of members 310—indicating, for example, the status of the respective (e.g., transmitting) member.

Figure 4:
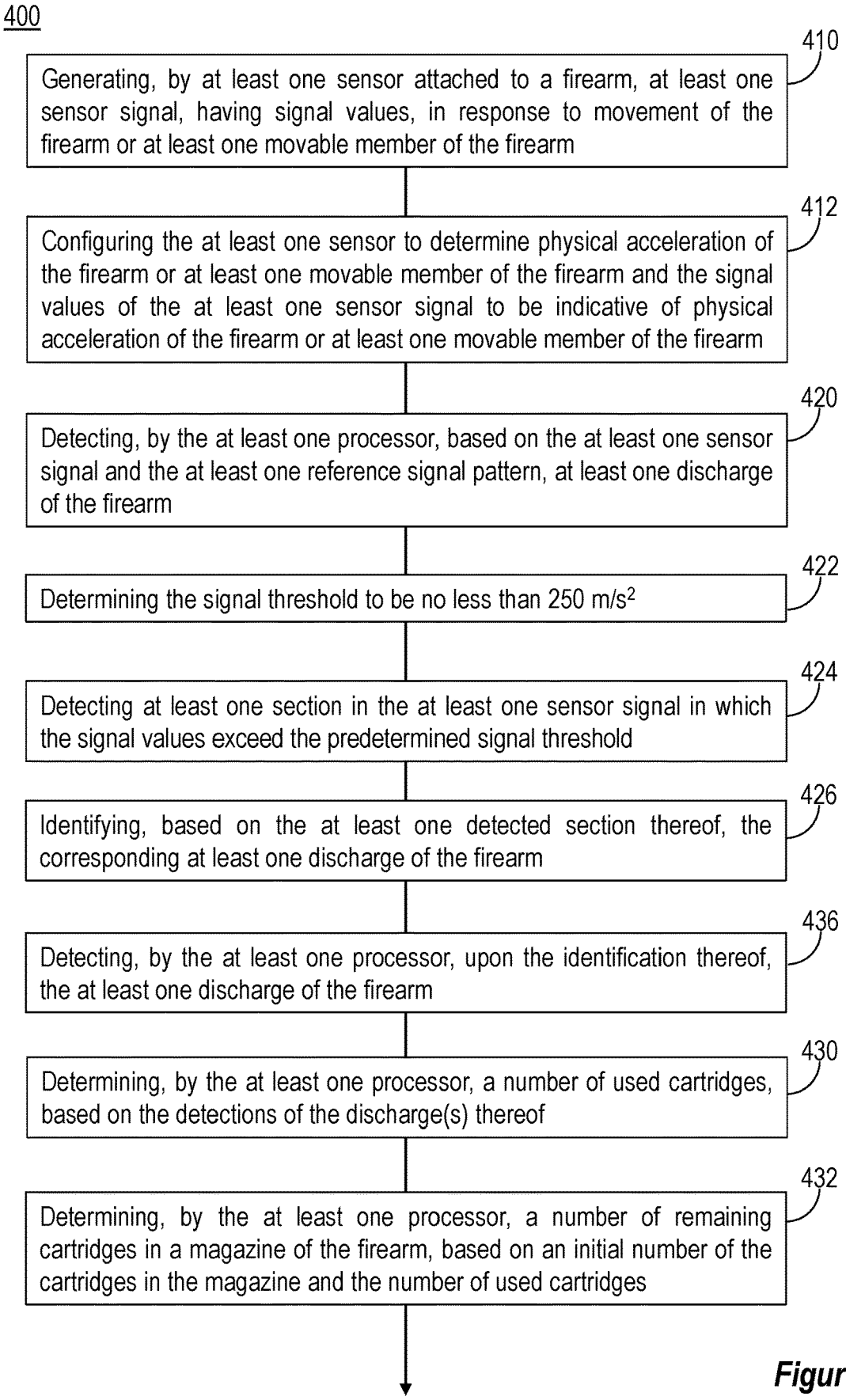
FIG. 4 is a flowchart of a method of counting used munitions, according to some embodiments of the invention.

Reference is now made to FIG. 4, which is a flowchart of a method 400 of counting used munitions, according to some embodiments of the invention.

Method 400 may be implemented by device 100, device 200 and/or system 300, which may be configured to implement method 400. It is noted that method 400 is not limited to the flowcharts illustrated in FIG. 4 and to the corresponding description. For example, in various embodiments, method 400 needs not move through each illustrated box or stage, or in exactly the same order as illustrated and described.

According to some embodiments, method 400 may include generating, by at least one sensor attached to a firearm, at least one sensor signal, having signal values, in response to movement of the firearm or at least one movable member of the firearm (stage 410).

In some embodiments, method 400 may include configuring the at least one sensor to determine physical acceleration of the firearm or at least one movable member of the firearm and the signal values of the at least one sensor signal to be indicative of physical acceleration of the firearm or at least one movable member of the firearm (stage 412).

According to some embodiments, method 400 may include detecting, by the at least one processor, based on the signal values of the at least one sensor signal and a predetermined signal threshold, at least one discharge of the firearm (stage 420).

In some embodiments, method 400 may include determining the signal threshold to be no less than 250 $m/s^2$ (stage 422).

In some embodiments, method 400 may include detecting at least one section in the at least one sensor signal in which the signal values exceed the predetermined signal threshold (stage 424). In some embodiments, method 400 may further include identifying, based on the at least one detected section thereof, the corresponding at least one discharge of the firearm (stage 426).

According to some embodiments, method 400 may include determining, by the at least one processor, a number of used cartridges, based on the detections of the discharge(s) thereof (stage 430).

In some embodiments, method 400 may further include determining, by the at least one processor, a number of remaining cartridges in a magazine of the firearm, based on an initial number of the cartridges in the magazine and the number of used cartridges (stage 432). In some embodiments, method 400 may further include generating, by at least one indicator, at least one notification indicative of the number of remaining cartridges in the magazine (stage 434). In some embodiments, method 400 may include configuring the at least one indicator to generate at least one visual notification (stage 436).

According to some embodiments, method 400 may include determining, by the at least one processor, a total number of the discharges of the firearm during a predetermined period of time (e.g., munities, hours, days, months, etc.) (stage 440). In some embodiments, method 400 may include recording, by the at least one processor, a date and/or a time of each/at least some of the discharges of the firearm (stage 442).

According to some embodiments, method 400 may include identifying, by at least one AIDC reader, at least one magazine of the firearm, by identifying corresponding at least one AIDC tag attached to the corresponding at least one magazine thereof (stage 450).

In some embodiments, method 400 may include determining, by the at least one processor, and storing, in a memory unit, the number of remaining cartridges for the at least one magazine (stage 452).

According to some embodiments, method 400 may include transmitting, by at least one device attached to corresponding at least one firearm of corresponding at least one member, information concerning at least the number of cartridges used by the corresponding at least one firearm to which the corresponding at least one device is attached and a geographical location of at least one of the at least one member (stage 460).

In some embodiments, method 400 may include receiving the information thereof by an analysis unit (stage 462). In some embodiments, method 400 may include determining, by the analysis unit, a number of cartridges to be supplied to the at least one member based on the number of cartridges used by the corresponding at least one firearm to which the corresponding at least one device is attached (stage 464).

Advantageously, the disclosed devices and methods may provide means for notifying the user of the firearm concerning the number of remaining cartridges in the magazine in a way that enables tactic use of the device while preventing any distraction/disturbance that may be caused by the device while operating the firearm and/or while eliminating a need in modifying the firearm.

Aspects of the present invention are described above with reference to flowchart illustrations and/or portion diagrams of methods, apparatus (systems) and computer program products according to embodiments of the invention. It will be understood that each portion of the flowchart illustrations and/or portion diagrams, and combinations of portions in the flowchart illustrations and/or portion diagrams, can be implemented by computer program instructions. These computer program instructions can be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or portion diagram or portions thereof.

These computer program instructions can also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or portion diagram portion or portions thereof. The computer program instructions can also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or portion diagram portion or portions thereof.

The aforementioned flowchart and diagrams illustrate the architecture, functionality, and operation of possible implementations of systems, methods and computer program products according to various embodiments of the present invention. In this regard, each portion in the flowchart or portion diagrams can represent a module, segment, or portion of code, which includes one or more executable instructions for implementing the specified logical function(s). It should also be noted that, in some alternative implementations, the functions noted in the portion can occur out of the order noted in the figures. For example, two portions shown in succession can, in fact, be executed substantially concurrently, or the portions can sometimes be executed in the reverse order, depending upon the functionality involved. It will also be noted that each portion of the portion diagrams and/or flowchart illustration, and combinations of portions in the portion diagrams and/or flowchart illustration, can be implemented by special purpose hardware-based systems that perform the specified functions or acts, or combinations of special purpose hardware and computer instructions.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A device for counting used munition, the device comprising:

at least one sensor attachable to a firearm and configured to generate at least one sensor signal, having signal values, in response to movement of at least one of: the firearm or at least one movable member of the firearm; and at least one processor in communication with the at least one sensor, wherein the at least one processor is configured to:

receive the at least one sensor signal from the at least one sensor;

detect at least one section in scalar sum array in the at least one sensor signal in which the signal values of the at least one sensor signal exceed a predetermined signal threshold, and detect, based on the signal values of the at least one sensor signal and the detected at least one section, at least one discharge of the firearm.

2. The device of claim 1, wherein the at least one sensor is accelerometer and the at least one sensor signal is indicative of physical acceleration of the firearm or the at least one movable member of the firearm.

3. The device of claim 1, wherein the at least one processor is configured to determine a number of used cartridges, based on the detections of the at least one discharge thereof.

4. The device of claim 3, wherein the at least one processor is configured to determine a number of remaining cartridges in a magazine, based on the number of used cartridges and an initial number of cartridges in the magazine.

5. The device of claim 3, further comprising at least one indicator coupled to the at least one processor and configured to generate at least one notification when the number of remaining cartridges in the magazine reduces below respective at least one predetermined threshold.

6. The device of claim 4, wherein the at least one indicator comprises at least one visual indicator configured to generate at least one visual notification.

7. The device of claim 3, further comprising an automatic identification and data capture (AIDC) reader coupled to the at least one processor, and at least one AIDC tag attachable to corresponding at least one magazine of the firearm, the AIDC reader is configured to identify each of the at least one magazine by identifying the respective AIDC tag attached thereto.

8. The device of claim 7, wherein the AIDC reader is a radiofrequency identification (RFID) reader.

9. The device of claim 6, further comprising a memory unit in communication with the at least one processor, wherein the at least one processor is configured to store in a memory unit the number of remaining cartridges for each of the at least one magazine.

10. The device of claim 3, further comprising a communication interface in communication with the at least one processor and configured to transmit the number of used cartridges.

11. A method for counting used munition, the method comprising:

generating, by at least one sensor attached to a firearm, at least one sensor signal, having signal values, in response to movement of the firearm or at least one movable member of the firearm;

detecting, by at least one processor, at least one section in scalar sum array in the at least one sensor signal in which the signal values of the at least one sensor signal exceed a predetermined signal threshold; and detecting, by the at least one processor, based on signal values of the at least one sensor signal and the detected at least one section, at least one discharge of the firearm.

12. The method of claim 11, further comprising configuring the at least one sensor to determine physical acceleration of the firearm or the at least one movable member of the firearm and the signal values of the at least one sensor signal to be indicative of physical acceleration of the firearm or the at least one movable member of the firearm.

13. The method of claim 11, further comprising determining, by at least one processor, at least one specific signal pattern associated with corresponding at least one post-discharging event to yield the at least one predetermined specific signal pattern.

14. The method of claim 11, further comprising determining, by the at least one processor, a number of used cartridges, based on the detections of the at least one discharge.

15. The method of claim 14, further comprising determining, by the at least one processor, a number of remaining cartridges in a magazine of the firearm, based on an initial number of the cartridges in the magazine and the number of used cartridges.

16. The method of claim 15, further comprising generating, by at least one indicator, at least one notification indicative of the number of remaining cartridges in the magazine.

17. The device of claim 1, wherein the at least one processor is configured to determine the at least one discharge of the firearm based on a signal pattern of the at least one sensor signal.

* * * * *